US006488790B1

(12) United States Patent
Hartmann et al.

(10) Patent No.: US 6,488,790 B1
(45) Date of Patent: Dec. 3, 2002

(54) METHOD OF MAKING A HIGH-STRENGTH LOW-ALLOY HOT ROLLED STEEL

(75) Inventors: John E. Hartmann, Frankfort, IL (US); R. Devesh K. Misra, Lafayette, LA (US); A. John Boucek, Hudson, OH (US)

(73) Assignee: International Steel Group Inc., Richfield, OH (US)

( * ) Notice: Subject to any disclaimer, the term of this patent is extended or adjusted under 35 U.S.C. 154(b) by 0 days.

(21) Appl. No.: 09/767,450

(22) Filed: Jan. 22, 2001

(51) Int. Cl.[7] ..... C21D 8/02
(52) U.S. Cl. ..... 148/602; 148/654; 148/661
(58) Field of Search ..... 148/602, 654, 148/661

(56) References Cited

U.S. PATENT DOCUMENTS

| | | | | |
|---|---|---|---|---|
| 2,863,763 A | | 12/1958 | Rosenberg et al. | |
| 3,211,593 A | | 10/1965 | Krekeler et al. | |
| 3,288,600 A | | 11/1966 | Johnsen, Jr. et al. | |
| 3,539,404 A | | 11/1970 | Retana | |
| 3,926,686 A | * | 12/1975 | Creswick et al. | 148/602 |
| 3,997,372 A | * | 12/1976 | Matas et al. | 148/602 |
| 4,001,052 A | | 1/1977 | Nakazato et al. | |
| 4,052,230 A | | 10/1977 | Aylward | |
| 4,225,365 A | | 9/1980 | Rice | |
| 4,388,122 A | | 6/1983 | Sudo et al. | |
| 4,441,936 A | | 4/1984 | Takahashi et al. | |
| 4,812,182 A | | 3/1989 | Fang et al. | |
| 4,830,686 A | | 5/1989 | Hashiguchi et al. | |
| 4,911,884 A | | 3/1990 | Chang | |
| 4,931,106 A | | 6/1990 | Tosaka et al. | |
| 4,985,090 A | | 1/1991 | Van Peristein et al. | |
| 5,017,248 A | | 5/1991 | Kawano et al. | |
| 5,030,297 A | | 7/1991 | Vespermann et al. | |
| 5,098,491 A | | 3/1992 | Osawa et al. | |
| 5,181,974 A | | 1/1993 | Tanabe et al. | |
| 5,382,307 A | | 1/1995 | Kageyama et al. | |
| 5,653,825 A | | 8/1997 | Kohno et al. | |
| 5,725,690 A | | 3/1998 | Ochi et al. | |

OTHER PUBLICATIONS

Development of an Ultra–High Strength Hot Rolled Steel, Misra, et al., 41st MWSP Conf. Proc. ISS, vol. XXXVII, 1999, pp. 509–514.

* cited by examiner

*Primary Examiner*—Deborah Yee
(74) *Attorney, Agent, or Firm*—Watts Hoffmann Fisher & Heinke

(57) ABSTRACT

A method of making a high-strength low-alloy (HSLA) hot rolled steel. A high-strength low-alloy steel is made by hot rolling a steel slab of a specified composition. The hot rolling step is carried out at an austenitic hot roll finishing temperature. The hot rolled steel is coiled at a temperature ranging from 1120° F. to 1180° F. The steel is characterized by a yield strength of at least 110 ksi. The steel may be further characterized by a ferrite-bainite microstructure.

6 Claims, 1 Drawing Sheet

METHOD OF MAKING A HIGH-STRENGTH LOW-ALLOY HOT ROLLED STEEL

FIELD OF THE INVENTION

This invention relates to high-strength low-alloy (HSLA) steels, and in particular, to a method of making an HSLA hot rolled steel having a unique composition of alloying elements and high yield strength.

BACKGROUND OF THE INVENTION

High-strength low-alloy steels are a group of steels intended for general structural or miscellaneous applications and have specified minimum yield points above 40,000 pounds per square inch (40 ksi). These steels typically contain small amounts of alloying elements to achieve their strength in hot-rolled or other normalized conditions. HSLA steels are available as sheet, strip, plates, bars and shapes. These steels are generally sold as proprietary grades. Advantageous characteristics of all-purpose HSLA steel include high strength, good formability, good weldability, and good toughness. In general, HSLA steel products are stronger and tougher than products made from structural carbon steel. HSLA steels also offer a high fatigue resistance to repeated loading, high abrasion resistance, and superior resistance to atmospheric corrosion.

Typical application areas for HSLA steels include mobile crane supports, earth moving equipment, truck rails, automobile parts, railroad freight cars and welded beams. HSLA steels can generally be used advantageously in any structural application in which their greater strength can be utilized either to decrease the weight or increase the durability of the structure.

A number of different compositions of HSLA steels containing various alloying elements have been developed which offer combinations of other properties and characteristics in addition to increased strength. Regardless of the composition of alloying elements used, the strength of an HSLA steel is primarily determined by its microstructures. HSLA steels conventionally have a ferrite-pearlite microstructure. In addition, some HSLA steels have been developed with a ferrite-bainite microstructure.

In an HSLA steel with a ferrite-bainite microstructure, a number of strengthening mechanisms are operative, namely, solid solution strengthening, grain refinement, precipitation hardening, transformation hardening (bainite strengthening), and dislocation hardening. Due to the multiple mechanisms in operation simultaneously, a process of making an HSLA steel with a ferrite-bainite microstructure must be optimized. Specifically, in order to achieve ultra high strength and excellent ductility, precipitation hardening and low temperature transformation hardening must be optimized.

Conventional HSLA steels have typically been produced at strength levels up to and including 80 ksi minimum yield strength. These steels are conventionally strengthened by a combination of grain refinement and precipitation strengthening requiring the addition of the precipitate forming elements, such as niobium (Nb), titanium (Ti) and vanadium (V), individually or in combination. If a structural application requires a steel with a 110 ksi yield strength, a conventional steel can be strengthened by heat treating processing steps, such as quenching and tempering.

Heat treating processes increase the labor costs, energy expense, and production cycle time associated with the treated steel versus "as hot rolled" steel. An HSLA steel which achieves strength levels of 110 ksi and offers the same mechanical properties, without the need for heat treatment, would be advantageous in many applications.

In addition, an HSLA product with increased yield strength could be substituted for a known steel characterized by a lesser yield strength, i.e., 80 ksi. The higher strength HSLA steel product could offer equivalent strength at proportionally reduced thickness. The effect would be to offer steel consumers, such as original equipment manufacturers, equivalent strength steel at reduced weight. This product offering would be beneficial in a variety of weight-sensitive applications, such as automobile design.

The development of an "as-rolled" HSLA steel with a yield strength of 110 ksi, sometimes referred to as an "ultra strength" HSLA steel, is desired in the steel manufacturing market. Any ultra strength steel developed must be characterized by a combination of strength and toughness, weldability, formability, and fatigue resistance in order to maximize its usage for a variety of applications.

Thus, there is a need in the steel manufacturing market for an HSLA steel characterized by high yield strength, beneficial mechanical properties, and the allowance of low weight components, which is produced by a cost, energy, and time effective method.

SUMMARY OF THE INVENTION

The present invention is directed to a method of producing a high-strength low-alloy (HSLA) hot rolled steel having a unique composition of alloying elements and high yield strength.

The resultant steel produced by a method in accordance with the present invention has a yield strength of at least 110 ksi, while offering beneficial mechanical properties of toughness, weldability, formability, and fatigue resistance. The method utilizes an alloying composition with an increased amount of molybdenum in combination with a precisely controlled coiling temperature.

A method of making a high-strength low-alloy steel comprises the first step of hot rolling a steel slab of the following composition (% by weight):

C: 0.03–0.08;
Mn: 1.3–1.8;
Mo: 0.15 to 0.30;
Ti: 0.05–0.10;
B: 0.0005–0.002;
Nb: 0.07–0.11;
Si: up to 0.50;
Al: 0.015–0.10;
S: up to 0.005; and
P: up to 0.03; with the balance being Fe and unavoidable impurities;

The hot rolling step is carried out at an austenitic hot roll finishing temperature. The hot rolled steel is coiled at a temperature ranging from 1120° F. to 1180° F. The resultant steel is characterized by having a yield strength of at least 110 ksi.

The steel may be further characterized as having a substantially ferrite and bainite microstructure. The volume fraction of bainite is typically 10 to 20%. The method may comprise the step of non-interrupted cooling after the hot rolling step to prevent recrystallization of deformed austenite, thereby increasing the nucleation sites for ferrite and bainite microstructures. The method may further comprise the step of rapid cooling directly after the hot rolling, whereby a fine ferrite grain size is achieved. The ferrite grain diameter is typically 3 to 8 microns.

More specifically, in another embodiment, the first step comprises hot rolling a steel slab of the following composition (% by weight):

C: 0.04–0.06;

Mn: 1.4–1.6;

Mo: 0.18 to 0.22;

Ti: 0.065–0.085;

B: 0.0005–0.001;

Nb: 0.08–0.09;

Si: up to 0.30;

Al: 0.020–0.070;

S: up to 0.005; and

P: up to 0.015; with the balance being substantially Fe and unavoidable impurities;

The hot rolling step is carried out at an austenitic hot roll finishing temperature. The hot rolled steel is coiled at a temperature ranging from 1120° F. to 1180° F. The resultant steel is characterized by having a ferrite-bainite microstructure and a yield strength of at least 110 ksi. The austenitic hot rolling finishing temperature may range from 1540° F. to 1630° F.

Many additional features and a fuller understanding of the invention will be had from the accompanying drawings and the detailed description that follows.

DETAILED DESCRIPTION OF PREFERRED EMBODIMENTS

Figure 1:
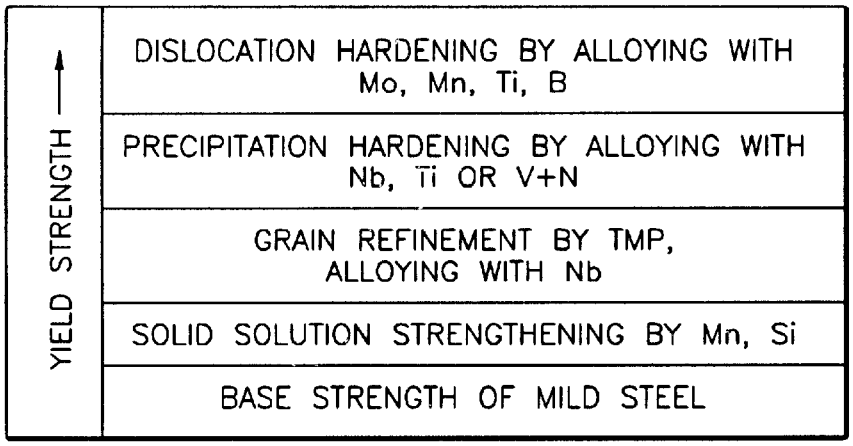
FIG. 1 is a schematic diagram showing the contributions of various strengthening mechanisms in an HSLA steel produced in accordance with a method of present invention.

One embodiment of the invention relates to a method of making a high-strength low-alloy (HSLA) steel having a yield strength of at least 110 ksi. The steel may be referred to as "ultra strength" steel. A specific alloying composition featuring a high molybdenum (Mo) content, i.e., above 0.10%, in combination with precise control of the coiling temperature is utilized to achieve consistent 110 ksi yield strength levels.

Referring again to one embodiment of the present invention, a HSLA steel is produced by hot rolling a steel slab of the following composition (% by weight):

C 0.03–0.08;

Mn 1.3–1.8;

Mo 0.15 to 0.30;

Ti 0.05–0.10;

B 0.0005–0.002;

Nb 0.07–0.11;

Si up to 0.50;

Al 0.015–0.10;

S up to 0.005; and

P up to 0.03; with the balance being substantially Fe and unavoidable impurities.

More specifically, in another embodiment of the present invention, a HSLA steel is produced by hot rolling a steel slab of the following composition (% by weight):

C: 0.04–0.06;

Mn: 1.4–1.6;

Mo: 0.18 to 0.22;

Ti: 0.065–0.085;

B: 0.0005–0.001;

Nb: 0.08–0.09;

Si: up to 0.30;

Al: 0.020–0.070;

S: up to 0.005; and

P: up to 0.015; with the balance being substantially Fe and unavoidable impurities;

Although not wanting to be bound by theory, each alloying element in the composition of the method is essential in presence and amount and contributes to achieving the required strength with good toughness.

Carbon is one of the more potent and economical strengthening elements. Carbon must be maintained at a relatively low level to assure good impact toughness in bainite-containing steels. The amount of C preferably ranges from 0.04 to 0.06% by weight.

Manganese generally exists in HSLA steel at a higher level than in structural carbon steels. Controlling the transformation temperature and kinetics, Mn allows a fine grain size to be attained. Mn is present in an amount preferably ranging from 1.4 to 1.6% by weight.

Niobium has become more important as a strengthening element as its commercial availability has increased. A small amount of Nb can significantly increase the yield point and to some extent, increase tensile strength. Nb also assists in achieving grain refinement by affecting the recrystallization during hot rolling as well as providing precipitation strengthening. The preferred range of Nb is 0.08 to 0.09% by weight.

Titanium is included in the HSLA steel composition. Ti provides significant precipitation strengthening. The preferred range of Ti is 0.065 to 0.085% by weight.

Boron is an important element in this composition. Both Mo and B, in combination with Mn, enhance the hardenability of this alloying composition to allow the formation of sufficient bainite to increase strength while maintaining sufficient impact toughness. However, excess B will cause cracking in the steel slab. The preferable range of B in this embodiment is 0.0005 to 0.001% by weight.

Mo is an important element in the composition of the present invention. Until the Mo content was increased to 0.15 to 0.30% by weight, in combination with the coiling temperature being optimized, steel of the present invention having consistently high yield strength of at least 110 ksi yield strength could not be produced. The preferred range of Mo in this embodiment is 0.18 to 0.22% by weight.

In this and in other embodiments of the present invention, the high strength level is achieved by a combination of microstructural strengthening mechanisms which are attained by a unique combination of alloying elements. The steel consists essentially of a ferrite-bainite microstructure. The portion of bainite is typically 10 to 20%. The microstructure of the HSLA steel, which results in an excellent combination of strength and toughness, consists of a combination of very fine-grained ferrite (grain diameter is typically 3 to 8 microns) and relatively low carbon bainite. The strengthening mechanisms employed in the microstructure of this steel are grain refinement, precipitation strengthening, and bainite strengthening.

The high strength of the HSLA steel produced in accordance with the present invention is expected to result from five major contributions. Referring to FIG. 1, the major contributions are shown in schematic form. The five major contributions are:

1) solid solution hardening from elements, such as manganese (Mn) and silicon (Si);
2) enhanced grain refinement by thermo-mechanical treatment;
3) dispersion hardening from the carbide particles, through alloying with niobium (Nb) and titanium (Ti);
4) dislocation hardening by alloying with Mo, Mn, Nb, Ti and B; and
5) slip band length, including both bainitic packet and lath size.

In comparison to a ferrite-pearlite microstructure of conventional HSLA steels, a bainitic microstructure gives further enhanced grain refinement plus additional strengthening by dislocations. Referring again to FIG. 1, Ti has a dual effect in optimizing precipitation strengthening as well as promoting bainitic strengthening. The ultra strength of the bainitic grade of the present invention is a cumulative contribution of a high dislocation density, a small grain size, and a high precipitation density of very fine carbides.

A main principal of the present invention is that the maximum yield strength of the microstructures is achieved when the increased molybdenum content is used in combination with precise coiling temperatures.

The production process for making a high-strength low-alloy steel in accordance with the present invention will now be described. A steel slab having a predetermined composition is hot rolled by a usual method. The hot rolling process is carried out at an austenitic hot roll finishing temperature. The austenitic hot rolling finishing temperature preferably ranges from 1540° F. to 1630° F. The resultant hot rolled steel strip is then cooled and made subject to a coiling process.

In the coiling process, the steel is cooled from the austenitic finishing temperature to a coiling temperature. At the coiling temperature, the steel strip is coiled per usual specifications. The hot rolled steel is preferably cooled directly after the last hot finish pass. More preferably, the hot rolled steel is cooled within one or two seconds after the last hot finish pass. The steel is coiled at a temperature ranging from 1120° F. to 1180° F. Preferably, the coiling temperature is 1140° F. to 1160° F., depending on the practical limitations of the processing equipment. Following coiling, the steel is allowed to gradually cool to atmospheric temperature over a period of one to two days.

The method of the present invention does not require a complicated cooling process. Interrupted cooling or two-stage cooling is not used. Rather, the steel is cooled via an "early water" practice. Heavy water sprays are applied to the top and bottom of the steel strip as soon as possible after the last hot finish rolling pass. This rapid and continuous cooling allows transformation directly after hot rolling and prevents recrystallization of deformed austenite, thereby increasing the nucleation sites for ferrite and bainite phases. The increased nucleation sites and rapid cooling combine to form a very fine grain size by increasing the nucleation rate and preventing grain growth. Again, the bainite grain size is typically 3 to 8 microns. This cooling practice also promotes the formation of bainite. Balancing the top and bottom water sprays minimizes problematic strip shape variations due to unequal cooling. Further, the process promotes uniform microstructure throughout the thickness of the strip.

The produced steel strip is characterized by having a yield strength of at least 110 ksi and a ferrite-bainite microstructure.

Examples of the present invention will now be given.

EXAMPLE 1

For purposes of example only, a composition of alloying elements in accordance with the present invention is outlined in Table 1 that follows. An experiment was conducted using the composition of Example 1, to produce samples made with varying coiling temperatures.

TABLE 1

Chemistry of Example 1

| Element | Symbol | % by Weight |
|---|---|---|
| Carbon | C | 0.054 |
| Manganese | Mn | 1.44 |
| Phosphorus | P | 0.01 |
| Sulfur | S | 0.003 |
| Silicon | Si | 0.058 |
| Copper | Cu | 0.01 |
| Tin | Sn | 0.002 |
| Nickel | Ni | 0.01 |
| Chromium | Cr | 0.024 |
| Molybdenum | Mo | 0.204 |
| Vanadium | V | 0.009 |
| Nitrogen | N | 0.0072 |
| Titanium | Ti | 0.081 |
| Columbium | Cb/Nb | 0.088 |
| Aluminum | Al | 0.061 |
| Boron | B | 0.0008 |
| Calcium | Ca | 0.003 |

Steel strips having the composition listed in Table 1 were subjected to three different coiling operations at varying temperatures. Each coil operation was assigned a Coil Number in Table 2 that follows. As detailed in Table 2, coiling temperatures of 1146° F., 1125° F., and 1101° F. were used. Yield strength, tensile strength, and percent elongation tests were performed by conventional methods. Several yield strength, tensile strength, and percent elongation measurements were conducted on each sample. The average values of the measurements for each sample are listed in Table 2.

TABLE 2

Effect of Coiling Temperature Variation

| Coil No. | Coiling Temperature (° F.) | Finishing Temperature (° F.) | Yield Strength (ksi) | Tensile Strength (ksi) | Percent Elongation |
|---|---|---|---|---|---|
| 1 | 1146 | 1640 | 118 | 127 | 17 |
| 2 | 1125 | 1601 | 110 | 121 | 15.5 |
| 3 | 1101 | 1632 | 99 | 112 | 15 |

As Table 2 indicates, the maximum yield strength, the maximum tensile strength and the highest percent elongation were achieved when the coiling temperature was within the preferred range of 1140° F. to 1160° F.

EXAMPLE 2

Figure 2:
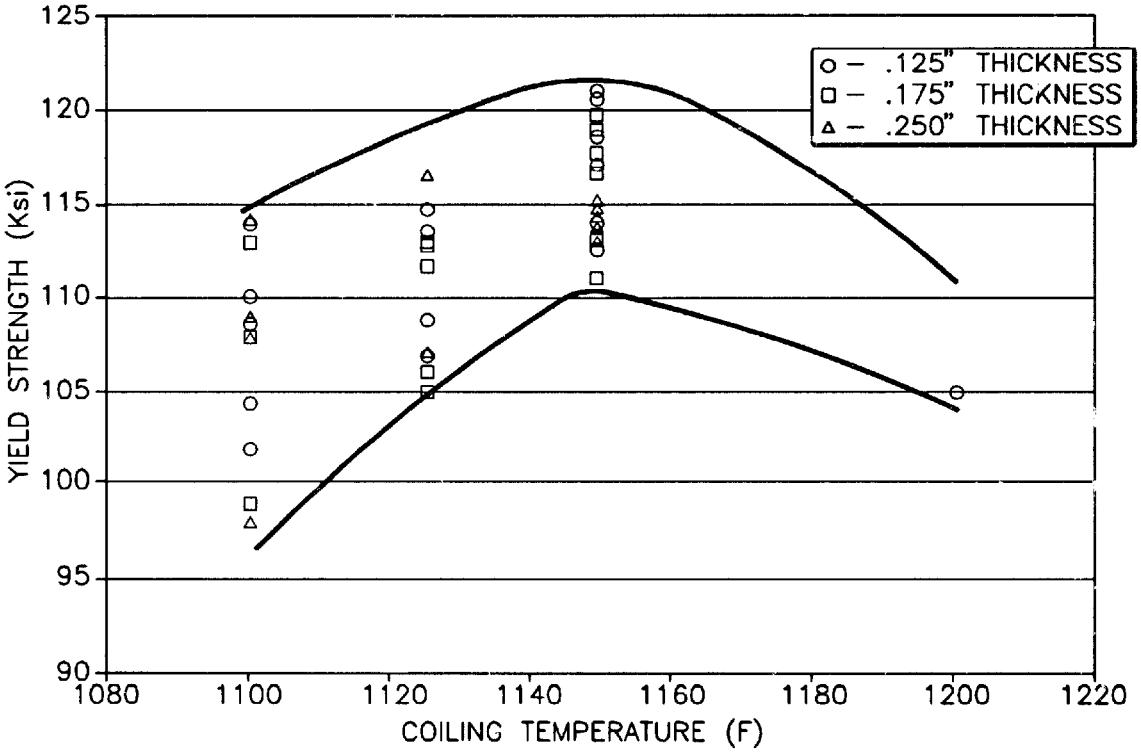
FIG. 2 is a graph plotting yield strength (ksi) versus coiling temperature (° F.), for three samples of hot rolled HSLA steel produced in accordance with a method of the present invention.

Additional experiments have been conducted by the Applicant. Referring to FIG. 2, a graph is shown plotting yield strength (ksi) versus coiling temperature (° F.) for various hot rolled HSLA steel samples. All samples were produced from compositions in accordance with a method of the present invention. HSLA steel of various thickness was tested for yield strength as a function of coiling temperature. By way of example only, HSLA steel with a thickness of 0.125", 0.175" and 0.250" were produced. More than one sample of each thickness was produced. As shown in FIG.

2, regardless of thickness, the optimum coiling temperature range to achieve maximum yield strength was 1120° F. to 1180° F., with 1140° F. to 1160° F. being preferred. When coiling temperatures less than 1120° F. were used, yield strength decreased at an increased rate. When coiling temperatures more than 1180° F. were used, yield strength also decreased at increased rate.

EXAMPLE 3

The high-strength low-alloy hot rolled steel produced in accordance with the present invention is expected to exhibit several advantageous mechanical properties. The Applicant has documented these advantageous mechanical properties during experimental testing.

For purposes of example only, a composition of alloying elements in accordance with the present invention is outlined in Table 3 that follows. An experiment was conducted using the composition of Example 3, to produce samples made with varying coiling temperatures.

TABLE 3

Chemistry of Example 3

| Element | Symbol | % by Weight |
|---|---|---|
| Carbon | C | 0.050 |
| Manganese | Mn | 1.56 |
| Phosphorus | P | 0.010 |
| Sulfur | S | 0.004 |
| Silicon | Si | 0.054 |
| Copper | Cu | 0.02 |
| Tin | Sn | 0.005 |
| Nickel | Ni | 0.010 |
| Chromium | Cr | 0.028 |
| Molybdenum | Mo | 0.193 |
| Vanadium | V | 0.008 |
| Nitrogen | N | 0.0084 |
| Titanium | Ti | 0.087 |
| Columbium | Cb/Nb | 0.089 |
| Aluminum | Al | 0.039 |
| Boron | B | 0.0010 |
| Calcium | Ca | 0.004 |

Steel strips having the composition listed in Table 3 was subjected to two different coiling operations at varying temperatures. Each coil operation was assigned a Coil Number in Table 4 that follows. As detailed in Table 4, coiling temperatures of 1133° F. and 1137° F. were used. Yield strength, tensile strength, and percent elongation tests were performed by conventional methods. Yield strength, tensile strength, and percent elongation measurements were conducted on each sample. The values for each sample are listed in Table 4 that follows.

TABLE 4

Effect of Coiling Temperature Variation

| Coil No. | Coiling Temperature (° F.) | Finishing Temperature (° F.) | Yield Strength (ksi) | Tensile Strength (ksi) | Percent Elongation |
|---|---|---|---|---|---|
| 4 | 1133 | 1609 | 117 | 123 | 17 |
| 5 | 1137 | 1563 | 111 | 120 | 20 |

As stated previously and shown in Table 4, HSLA steel made in accordance with this invention has a minimum yield strength of 110 ksi. The steel has an elongation percentage of 15 to 25%.

It is expected that the steel of the present invention will exhibit other beneficial mechanical properties. It is expected the steel will have high impact toughness, excellent edge formability, high fatigue resistance, and excellent weldability.

It is also expected the steel will exhibit superior mechanical properties to a heat treated HSLA offering similar yield strength.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of making a high-strength low-alloy steel comprising the steps of:

hot rolling a steel slab consisting essentially of the following composition (% by weight):

C: 0.03–0.08;
Mn: 1.3–1.8;
Mo: 0.15 to 0.30;
Ti: 0.05–0.10;
B: 0.0005–0.002;
Nb: 0.07–0.11;
Si: up to 0.50;
Al: 0.015–0.10;
S: up to 0.005; and
P: up to 0.03; with the balance being Fe and unavoidable impurities;

wherein said hot rolling step is carried out at an austenitic hot roll finishing temperature; and coiling the hot rolled steel at a temperature ranging from 1120° F. to 1180° F.;

wherein said steel is characterized by having a yield strength of at least 110 ksi.

2. The method of claim 1 wherein said steel is further characterized by substantially a ferrite and bainite microstructure.

3. The method of claim 1 comprising the step of non-interrupted cooling after said hot rolling to prevent recrystallization of deformed austenite, thereby increasing the nucleation sites for ferrite and bainite microstructures.

4. The method of claim 1 comprising the step of rapid cooling directly after said hot rolling, whereby a fine ferrite grain size is achieved.

5. A method of making a high-strength low-alloy steel comprising the steps of hot rolling a steel slab of the following composition (% by weight):

C: 0.04–0.06;
Mn: 1.4–1.6;
Mo: 0.18 to 0.22;
Ti: 0.065–0.085;
B 0.0005–0.001;
Nb: 0.08–0.09;
Si: up to 0.30;
Al: 0.020–0.070;
S: up to 0.005; and
P: up to 0.015; with the balance being/substantially Fe and unavoidable impurities;

wherein said hot rolling step is carried out at an austenitic hot roll finishing temperature; and coiling the hot rolled steel at a temperature ranging from 1120° F. to 1180° F.;

wherein said steel is characterized by having a ferrite-bainite microstructure and a yield strength of at least 110 ksi.

6. The method of claim 5 wherein said austenitic hot rolling finishing temperature ranges from 1540° F. to 1630° F.

* * * * *